US010005597B2

(12) United States Patent
Courtin

(10) Patent No.: US 10,005,597 B2
(45) Date of Patent: Jun. 26, 2018

(54) DEVICE FOR DISPENSING AND PROTECTING A FLUID, COMPRISING A SLIT STOPPER

(71) Applicant: Karine Courtin, Boulogne Billancourt (FR)

(72) Inventor: Karine Courtin, Boulogne Billancourt (FR)

(73) Assignee: Karine Courtin, Boulogne Billancourt (FR)

( * ) Notice: Subject to any disclaimer, the term of this patent is extended or adjusted under 35 U.S.C. 154(b) by 0 days. days.

(21) Appl. No.: 15/027,863

(22) PCT Filed: Oct. 8, 2014

(86) PCT No.: PCT/EP2014/071500
§ 371 (c)(1),
(2) Date: Apr. 7, 2016

(87) PCT Pub. No.: WO2015/052211
PCT Pub. Date: Apr. 16, 2015

(65) Prior Publication Data

US 2016/0244223 A1 Aug. 25, 2016

(30) Foreign Application Priority Data

Oct. 10, 2013 (FR) ..... 13 59844

(51) Int. Cl.
*B65D 47/20* (2006.01)
*B65D 83/00* (2006.01)

(52) U.S. Cl.
CPC ..... *B65D 47/2031* (2013.01); *B65D 83/005* (2013.01)

(58) Field of Classification Search
CPC ..... B65D 47/2031; B65D 83/005; B65D 47/2093; B65D 47/2037
(Continued)

(56) References Cited

U.S. PATENT DOCUMENTS 1,739,871 A * 12/1929 Smith ..... B65D 47/2031 222/490
1,979,166 A * 10/1934 Manzardo ..... B65D 47/2093 222/492

(Continued)

FOREIGN PATENT DOCUMENTS

FR 955 907 A 1/1950
FR 13 59844 6/2014

OTHER PUBLICATIONS

Search Report issued in French Patent Application No. FR 13 59844 dated Jun. 12, 2014.

(Continued)

*Primary Examiner* — Charles P Cheyney
(74) *Attorney, Agent, or Firm* — Pearne & Gordon LLP

(57) ABSTRACT

A device for dispensing a fluid product, comprising a body, a slit stopper formed in the body, being made from an elastically deformable material and delimited by an external face and an internal face, the slit stopper comprising a slit approximately parallel to the principal plane of the device, that extends from the internal face to the external face, and that comprises two facing walls that bear in contact with each other and that can move apart following a movement perpendicular to the principal plane of the device under pressure from the product to be dispensed, by elastic strain of the slit stopper. The slit stopper comprises a groove made in the internal face, that comprises two inclined faces each of which prolongs a wall of the slit in the inwards direction. The device may include a layer of material with bactericide or bacteriostatic properties on its external face.

9 Claims, 5 Drawing Sheets

(58) Field of Classification Search
USPC ..... 222/490, 496, 213, 207, 212, 492, 449, 222/494
See application file for complete search history.

(56) References Cited

U.S. PATENT DOCUMENTS 2,011,742 A * 8/1935 Weber ..... B65D 47/2018 222/494
2,084,529 A * 6/1937 Landau ..... B65D 35/36 222/490
2,135,237 A * 11/1938 Lewis ..... B65D 47/2037 138/89.3
2,620,949 A * 12/1952 Cole ..... B65D 47/2031 222/490
2,997,216 A * 8/1961 Henry ..... B65D 47/2037 222/490
3,684,137 A * 8/1972 Coleman ..... B65D 47/2037 222/490
4,546,906 A * 10/1985 Vadnais ..... B05C 17/005 222/502
4,711,373 A * 12/1987 Christine ..... A47K 5/122 222/105
5,145,707 A 9/1992 Lee
5,186,368 A * 2/1993 Garcia ..... B05B 11/007 222/321.3
5,450,375 A 9/1995 Woo
5,950,877 A * 9/1999 Garcia ..... A61M 15/08 222/190
7,886,941 B2 * 2/2011 Pietrowski ..... B05B 1/323 222/321.7
2008/0035677 A1 2/2008 Daansen

OTHER PUBLICATIONS

International Preliminary Report on Patentability issued in Application No. PCT/EP2014/071500 dated Oct. 7, 2015.
International Search Report issued in Application No. PCT/EP2014/071500 dated Dec. 18, 2014.
Written Opinion issued in Application No. PCT/EP2014/071500 dated Dec. 18, 2014.

* cited by examiner

DEVICE FOR DISPENSING AND PROTECTING A FLUID, COMPRISING A SLIT STOPPER

TECHNICAL DOMAIN

The invention relates to a fluid dispensing device with the purpose of limiting risks of pollution of the preparation to be dispensed by air or particularly by contaminating bacteria.

For example, the invention relates to a device for dispensing a product being in the form of a cream, a paste, a gel or a liquid for the pharmaceutical, cosmetic, chemical or food processing industry, contained in a semi-rigid tube or a jar.

STATE OF PRIOR ART

Many products in paste or liquid form are contained in a receptacle that both protects and dispenses the product.

The product is usually preserved by means of a receptacle hermetically sealed against air and also by adding preservatives, antioxidants, bactericides, etc., into the product.

There is also a product pollution source located at the dispensing device. The dispensing device comprises a product outlet opening at which air can penetrate inside the container and pollute the product.

Furthermore, the product is drawn off by sliding over the outside surface of the device, for example using the finger. This sliding action adds bacteria or other pollutants onto the outside surface but also disseminates them.

Document WO-A-2013/039482 discloses a slit stopper that can completely close off the opening in the dispensing device, thus preventing air from entering into the container.

The slit stopper consists of a disk made of an elastic deformable material with a slit at the centre, for example a cross-shaped slit.

When pressure is applied on the container, the pressure within the product to be dispensed increases, thus causing deformation of the stopper at the slit. Elastic parts formed by the slit deform elastically along a forwards axial and outwards radial movement, following the movement of the product.

When pressure on the container is released, the product contact pressure with the stopper is not sufficient, and the stopper then returns to its original position. When the stopper has elastically returned to its initial shape, a certain quantity of product that was in contact with external air and various pollutants that could pollute the product, returns inside the container.

Therefore, the product is not fully protected by such a stopper.

The purpose of the invention is to disclose a dispensing device with a slit stopper made so as to completely protect the product contained in the receptacle against ingress of air and pollutants, to guarantee that the product will not be deteriorated the next time it is used.

PRESENTATION OF THE INVENTION

The invention discloses a dispensing device for a fluid product comprising a body that extends in a plane orthogonal to a principal plane of the device, that comprises a central housing, a slit stopper arranged in the central housing of the body, that is made from an elastically deformable material and that is delimited by an external face, an internal face and a peripheral wall, the slit stopper comprising a slit approximately parallel to the principal plane of the device, that extends from the internal face to the external face, and that comprises two facing walls that bear in contact with each other and that can move apart following a movement perpendicular to the principal plane of the device under pressure from the product to be dispensed, by elastic deformation of the slit stopper, characterised in that the slit stopper comprises a groove made in the internal face, that comprises two inclined faces each of which extends a wall of the slit in the inwards direction.

Due to the relative movement of the two walls formed by the slit, such an embodiment of the dispensing device prevents part of the product that might have been in contact with an external pollutant as the result of opening and closing the dispensing orifice, from returning into the container. The groove formed on the back face of the slit stopper facilitates separation of the two walls, due to pressure applied by the product.

Preferably, the slit stopper comprises a rib projecting from its peripheral wall that fits into an associated groove in the central housing, and in that there is a radial clearance present between the bottom of the radial groove and the free end of the rib.

Preferably, the body comprises an external face covered by a layer made of a bactericide or at least bacteriostatic material and the material layer comprises a central opening through which the slit stopper passes such that the external face of the slit stopper is flush with the external face of the material layer.

Preferably, the material layer is made by metallic deposition on the external face of the body.

Preferably, the material layer consists of a metal plate crimped onto the body, covering the external face of the body.

Preferably, the material layer is made from copper or silver.

Preferably, the external face of the material layer and the external face of the slit stopper form a plane, concave or convex application surface.

Preferably, the device is made from a single part with a receptacle containing the product.

Preferably the receptacle is rigid and comprises a moving wall and a fixed wall on which the device is fixed.

Preferably, the receptacle is rigid and comprises a moving wall on which the device is fixed.

BRIEF DESCRIPTION OF THE DRAWINGS

Other characteristics and advantages of the invention will become clear after reading the following detailed description that can be more easily understood by referring to the appended figures among which.

DETAILED DESCRIPTION OF PARTICULAR EMBODIMENTS

Figure 1:
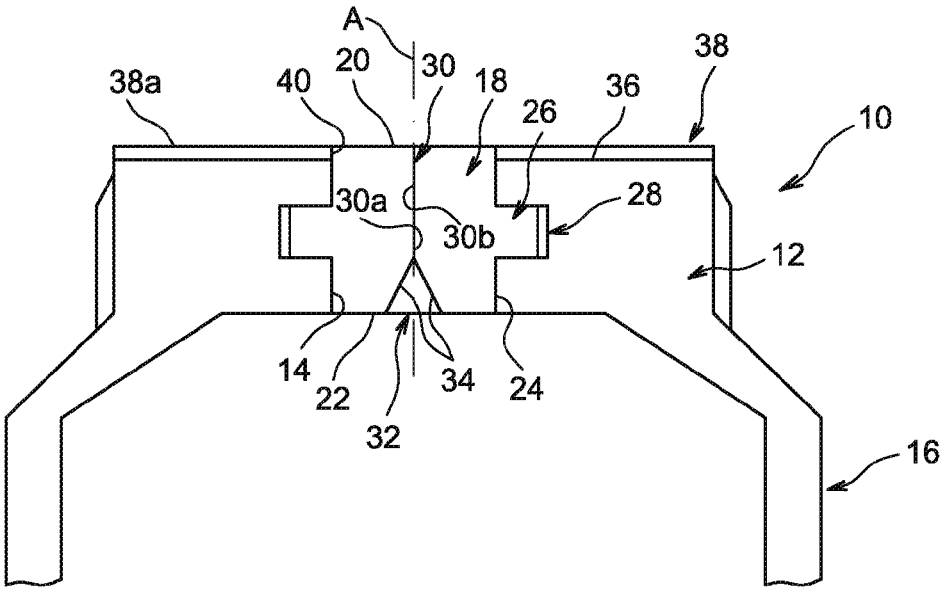
FIG. 1 is a diagrammatic axial sectional view of a device according to the invention.
Figure 2:
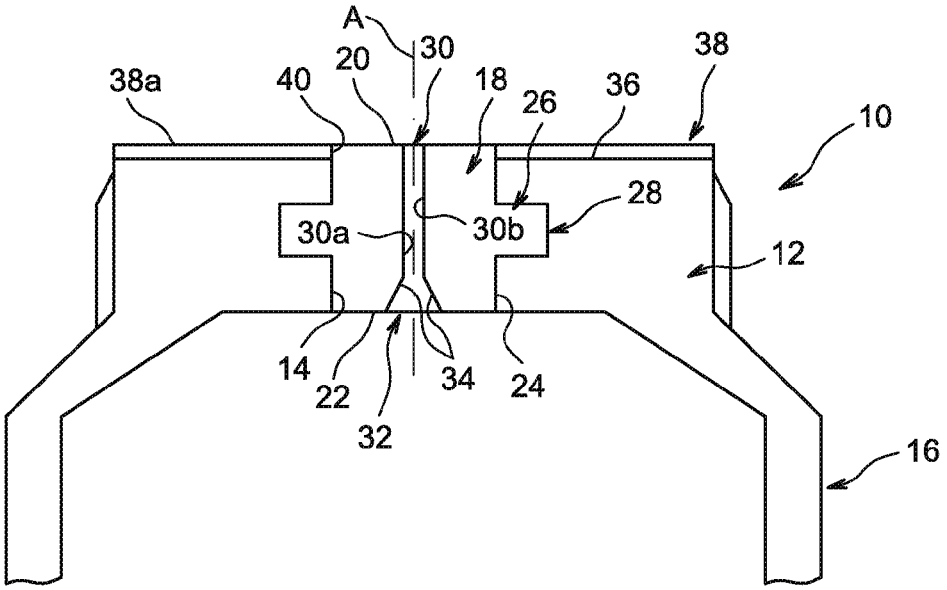
FIG. 2 is a view similar to that in FIG. 1, in which the walls of the slit are moved apart during dispensing of the product.

FIGS. 1 and 2 show a dispensing device 10, for dispensing a fluid such as a paste, cream, gel or liquid solution for example.

The device 10 comprises a median principal plane A located at its centre.

The device 10 comprises a principal body 12 that has a principal orientation perpendicular to the principal plane A and that comprises a central housing 14.

The device 10 forms part of a receptacle 16 inside which the product to be dispensed is contained. For example, the receptacle consists of a tube made from a semi-rigid or soft elastic material, or the receptacle 16 is composed of a rigid receptacle such as a jar, shown for example in FIGS. 7A and 7B.

A slit stopper 18 is arranged inside the housing 14 and hermetically closes the housing 14.

The slit stopper 18 consists of an elastically deformable element installed in the housing 14. It is delimited by an external face 20, at which the product leaves the receptacle 16, an inside face 22 that is in contact with the product contained in the receptacle 16 and a peripheral wall 24 that is in sealing contact with the wall of the housing 14.

The peripheral wall 24 comprises a rib 26 that fits into an associated groove 28 made in the housing 14. The rib 26 projects from the peripheral wall 24 and it can extend over its entire periphery, as can be seen for example in FIGS. 5A to 5C, or over only part of it. The rib 26 and the groove 28 associated with it retain the slit stopper 18 in the housing 14 by elastic insertion.

The slit stopper 18 also comprises a slit 30 that extends parallel to the principal plane A and preferably in this principal plane A from the internal face 22 as far as the external face 20. The slit 30 comprises two walls 30*a*, 30*b* facing each other, that are adjoined to each other when the stopper 18 is in a closed position shown in FIG. 1, and move away from each other when the stopper 18 is in an open position shown in FIG. 2, enabling the product to flow through the slit 30.

The slit 30 is opened under the action of pressure from the product contained in the receptacle 16. When this pressure becomes sufficiently high, it causes separation of the two walls 30*a*, 30*b* facing each other. When the pressure reduces, the walls 30*a*, 30*b* facing each other move towards each other until they bear in contact with each other.

In this case, the relative movement of the walls 30*a*, 30*b* facing each other consists of a movement of the walls in opposite directions orthogonal to the principal plane A of the device 10. This relative movement is achieved by making a slit stopper 18 for which the distance between the internal face 22 and the external face 20 is sufficiently large in comparison with the dimension of the slit stopper 18 along a direction perpendicular to the principal plane A.

Such a relative movement of the walls 30*a*, 30*b* when the pressure in the product contained in the receptacle 16 is released, is sufficient to compress the product film present between the walls 30*a*, 30*b*. The product is then forced inwards into the receptacle 16 through the internal face 22 and also outwards through the external face 20.

The product that might have been in contact with pollutants or with air, is thus forced outwards, and cannot contaminate the remainder of the product that returns inside the receptacle 16.

During the relative movement of the walls 30*a*, 30*b* facing each other, the slit stopper 18 deforms elastically. To achieve this, the stopper is made from an elastically deformable material for example such as an elastomer, natural or synthetic rubber or polytetrafluoroethylene (Teflon®).

There is a clearance between the bottom of the groove 28 and the associated free end of the rib 26. This clearance reduces during the elastic deformation of the slit stopper and the separation of the walls 30*a*, 30*b*.

The slit stopper 18 comprises a groove 32 formed in the internal face 22, that extends the slit 30 inwards, to facilitate separation of the walls under the action of the product pressure. In this case, the groove 32 is "V"-shaped, and thus comprises two faces 34 inclined from the principal plane A, each of which extends one wall 30*a*, 30*b* of the slit 30 inwards.

Due to this groove 32, pressure applied by the product on each of the inclined faces 34 of the groove 32 creates a resultant force inclined from the internal face and moving away from the principal plane A of the device 10.

The receptacle 16 is preferably made from an elastic deformable material. Thus, to dispense a given quantity of product, the user applies pressure on the walls of the receptacle 16, causing an increase in the product pressure inside the receptacle until the walls 30*a*, 30*b* facing each other separate, and the product dispensing orifice opens and product can come out of the receptacle.

When a given quantity of product has been dispensed, the user stops pressing on the walls of the receptacle 16. The product pressure in the receptacle reduces, the walls 30*a*, 30*b* of the slit 30 return elastically to their initial position in which they bear in contact with each other, thus closing the dispensing orifice.

The bearing contact of the walls 30*a*, 30*b* facing each other is sufficient to close the dispensing orifice that is sealed against air and pollutants. Thus, the receptacle 16 that was also compressed to dispense the product, tends to return elastically to its initial shape, causing some suction. This suction is the result of the reduction in the quantity product present in the receptacle 16 due to the quantity of product that has been dispensed, and this prevents the receptacle 16 from returning to its initial shape.

Suction then further forces the walls 30*a*, 30*b* of the slit 30 to bear in contact with each other, to further improve closing of the product dispensing orifice and prevent air from entering the receptacle 16.

In order to achieve hygienic dispensing of the product, the device 10 is made from a material that limits proliferation of bacteria at its external product dispensing face.

This purpose is achieved by the external face 20 of the slit stopper 18 being smooth, in other words having a low roughness. Thus, it does not contain any rough surfaces in which the product could be retained and in which bacteria could develop.

This purpose can also be achieved by the use of a material with a bactericide effect, or at least a bacteriostatic effect, in other words a material that limits the development of bacteria. For example, such a material may be copper, silver or an alloy based on one of these materials.

This material is placed on the device 10, covering the external face 36 of the body 12 and forming a material layer 38.

According to the embodiment shown in FIGS. 1 and 2, the material layer 38 is deposited on the application face 36 for example by electrolysis or more particularly by electroplating.

Figure 3:
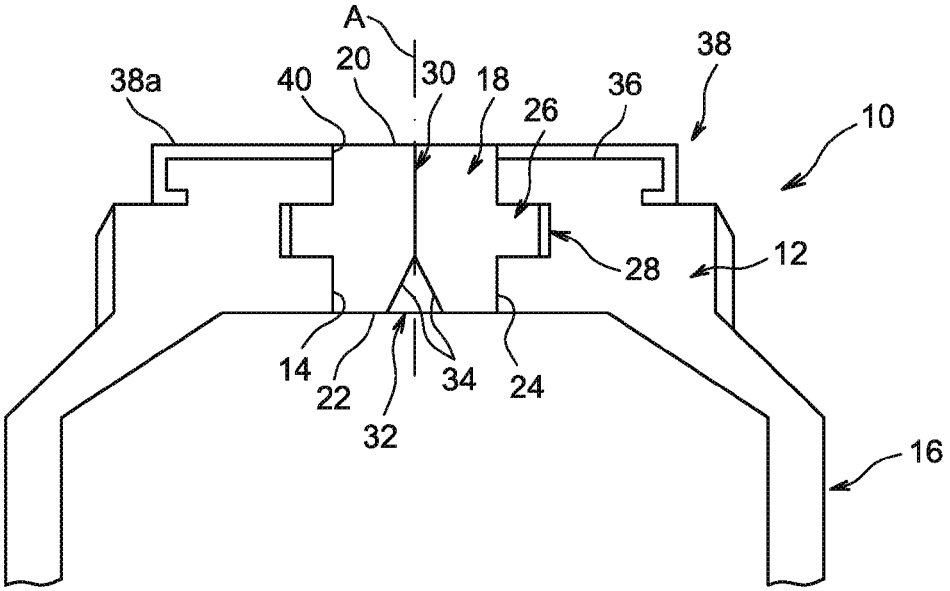
FIG. 3 is a view similar to that in FIG. 1, in which the metallic layer is formed by a plate crimped onto the body of the device.
Figure 4:
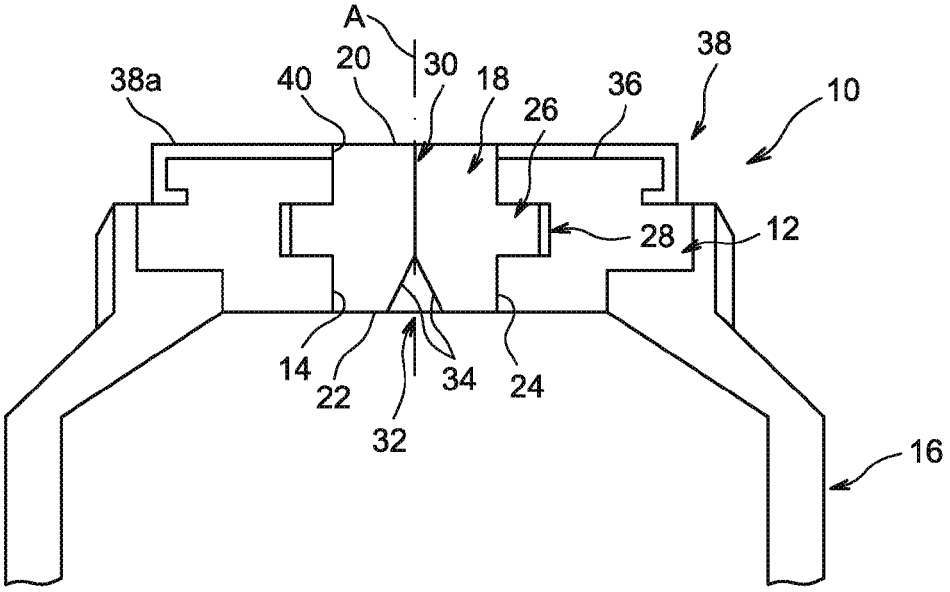
FIG. 4 is a view similar to that in FIG. 3, in which the device consists of an add-on element on the receptacle.

According to another embodiment shown in FIGS. 3 and 4, the material layer 38 is in the form of a thin plate crimped onto the body 12.

The material layer 38, that may be the deposited layer or the thin plate, comprises a central orifice 40 through which the external end of the slit stopper 18 passes.

Figure 5A:
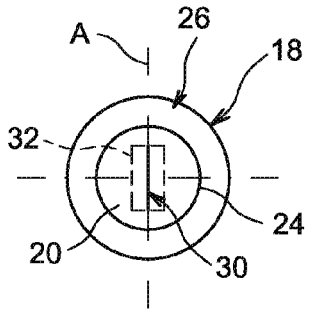
FIGS. 5A, 5B, 5C are diagrammatic views showing the various possible shapes of the slit stopper.
Figure 5B:
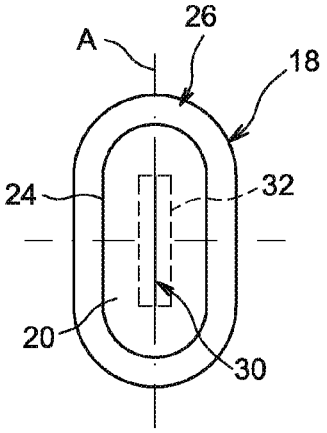
Figure 5C:
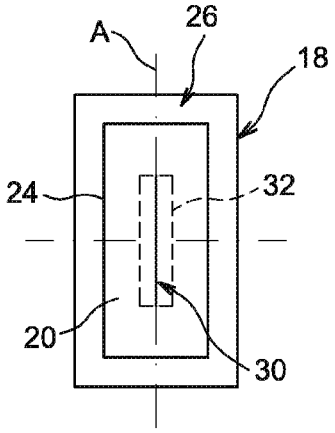

As shown in FIGS. 5A to 5C, the slit stopper 18, and consequently the central orifice 40 of the material layer 38, may have different shapes, complementary to each other.

Thus for example, the shapes of the slit stopper 18 and the central orifice 40 are mainly circular as shown in FIG. 5A, or oval or oblong as shown in FIG. 5B, or rectangular as shown in FIG. 5C.

The external face 20 of the slit stopper 18 is flush with the external face 38*a* of the material layer 38, which limits roughness at the connection between the two external faces 20, 38*a*, in which the product could have been retained and bacteria could have developed.

According to the embodiment shown in FIGS. 1 to 3, the dispensing device 10 is made from a single part with the rest of the receptacle 16.

According to the embodiment shown in FIG. 4, the dispensing device 10 consists of an add-on element on the remainder of the receptacle 16 that is fixed for example by crimping, gluing or bonding.

Figure 6A:
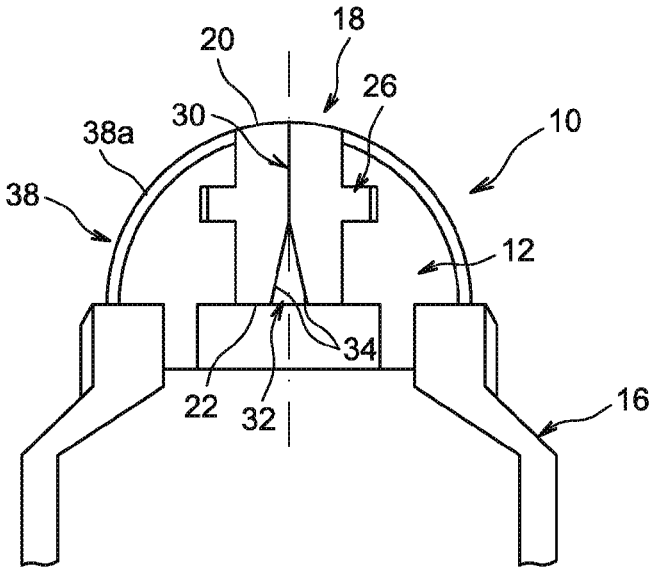
FIGS. 6A and 6B are views similar to that in FIG. 1, in which the dispensing surface of the device is curved and convex or concave.
Figure 6B:
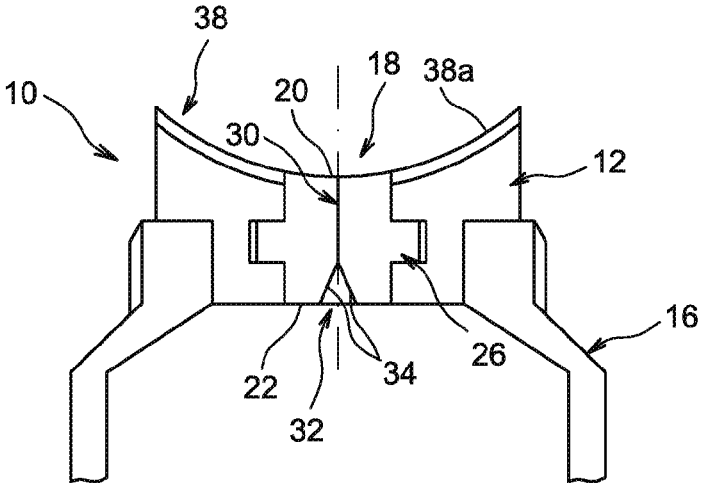

According to the embodiments shown in FIGS. 1 to 4, the application face of the dispensing device 10, formed by the external face 20 of the slit stopper 18 and the external face 38*a* of the material layer 38, is plane. It will be understood that the invention is not limited to this embodiment and that it may be convex as shown in FIG. 6A, or concave as shown in FIG. 6B.

Figure 7A:
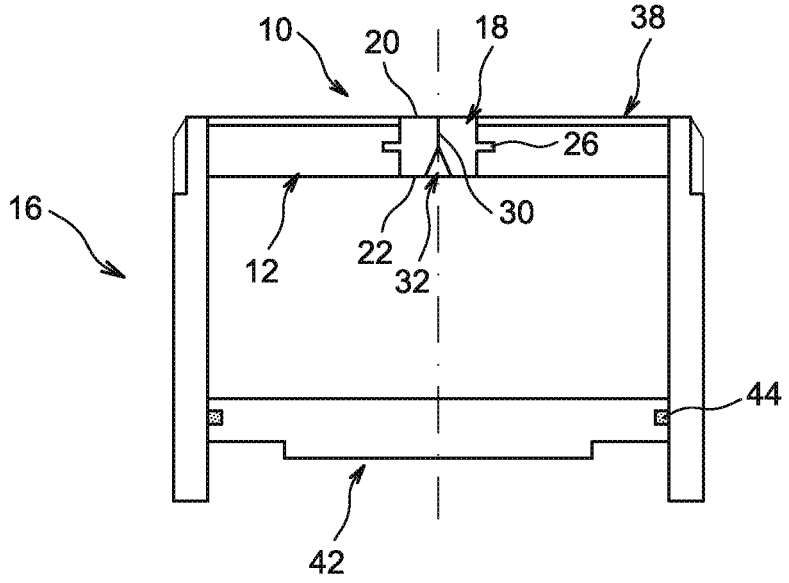
FIGS. 7A and 7B are cross-sections of rigid receptacles comprising a moving rigid wall and in which the device is or is not installed on the moving wall.
Figure 7B:
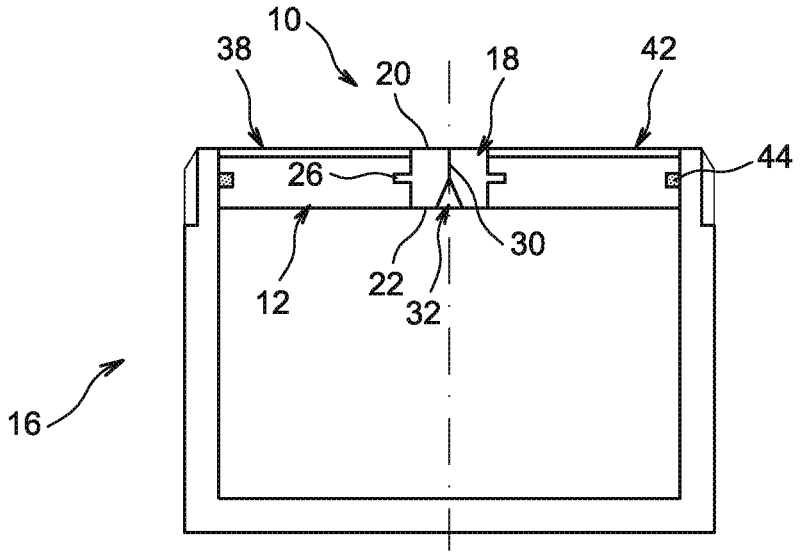

FIGS. 7A and 7B also show another variant embodiment of the dispensing device 10 that is used in association with a rigid receptacle 16.

According to these embodiments, the receptacle 16 comprises a wall 42 installed free to slide to make the product move outwards when a user applies pressure on this wall 42. When the product has been dispensed, the user stops pressing on the wall 42, the slit stopper 18 automatically closes the dispensing orifice as described above, which retains the sliding wall 42 in its position.

Sealing means 44 are also provided between the moving wall 42 and the remainder of the receptacle 16.

According to the embodiment shown in FIG. 7A, the moving wall 42 is a bottom wall of the receptacle 16 that is opposite the wall of the receptacle comprising the dispensing device according to the invention.

According to the embodiment shown in FIG. 7B, the moving wall 42 is the top wall of the receptacle 16 in which the dispensing device 18 is installed.

What is claimed is:

1. Device (10) for dispensing a fluid product, comprising a body (12) that extends in a plane orthogonal to a principal plane (A) of the device (10), that comprises a central housing (14), a slit stopper (18), comprising a main axis included in the principal plane (A) of the device, that is arranged in the central housing (14) of the body (12), that is made as a single piece from an elastically deformable material and that is delimited by an external face (20), an internal face (22) and a peripheral wall (24), the slit stopper (18) comprising a slit (30) approximately parallel to the principal plane (A) of the device (10), that extends from the internal face (22) to the external face (20), and that comprises two facing walls (30*a*, 30*b*) that bear in contact with each other, wherein the edges of the two facing walls (30*a*, 30*b*) are located at a distance from the peripheral wall (24) of the slit stopper (18) and can move apart following a movement perpendicular to the principal plane (A) of the device (10) under pressure from the product to be dispensed, by elastic deformation of the slit stopper (18), wherein the slit stopper (18) comprises a groove (32) made in the internal face (22), said groove being wedge shaped with planar faces and comprising two inclined faces (34) each of which extends a wall (30*a*, 30*b*) of the slit (30) in the inwards direction, wherein the slit stopper (18) comprises a rib (26) projecting from its peripheral wall (24) that fits into an associated groove (28) in the central housing (14), and in that there is a clearance, extending radially with respect to the main axis of the slit stopper (18), present between the bottom of the radial groove (28) and the free end of the rib (26).

2. Device (10) according to claim 1, wherein the body (12) comprises an external face (20) covered by a layer (38) made of a bactericide or at least bacteriostatic material, and in that the material layer (38) comprises a central opening (40) through which the slit stopper (18) passes such that the external face (20) of the slit stopper (18) is flush with the external face (20) of the material layer (38).

3. Device (10) according to claim 2, wherein the material layer (38) is made by metallic deposition on the external face (36) of the body (12).

4. Device (10) according to claim 2, wherein the material layer (38) consists of a metal plate crimped onto the body (12), covering the external face (36) of the body (12).

5. Device (10) according to claim 2, wherein the material layer (38) is made from copper or silver.

6. Device (10) according to claim 2, wherein the front face (38*a*) of the material layer (38) and the external face (20) of the slit stopper (18) form a plane, concave or convex application surface.

7. Device (10) according to claim 1, wherein the device (10) is made from a single part with a receptacle (16) containing the product.

8. Device (10) according to claim 7, wherein the receptacle is rigid and comprises a moving wall (42) and a fixed wall on which the device (10) is fixed.

9. Device (10) according to claim 7, wherein the receptacle is rigid and comprises a moving wall (42) on which the device (10) is fixed.

* * * * *